US010115408B2

(12) United States Patent
Malenovsky

(10) Patent No.: US 10,115,408 B2
(45) Date of Patent: Oct. 30, 2018

(54) DEVICE AND METHOD FOR QUANTIZING THE GAINS OF THE ADAPTIVE AND FIXED CONTRIBUTIONS OF THE EXCITATION IN A CELP CODEC

(71) Applicant: VOICEAGE CORPORATION, Town of Mount Royal (CA)

(72) Inventor: Vladimir Malenovsky, Sherbrooke (CA)

(73) Assignee: VOICEAGE CORPORATION, Town of Mount Royal, Quebec (CA)

( * ) Notice: Subject to any disclaimer, the term of this patent is extended or adjusted under 35 U.S.C. 154(b) by 0 days.

(21) Appl. No.: 15/610,268

(22) Filed: May 31, 2017

(65) Prior Publication Data

US 2017/0270943 A1 Sep. 21, 2017

Related U.S. Application Data

(60) Continuation of application No. 15/461,945, filed on Mar. 17, 2017, which is a continuation of application (Continued)

(51) Int. Cl.
*G10L 19/083* (2013.01)
*G10L 19/12* (2013.01)

(Continued)

(52) U.S. Cl.
CPC ..... *G10L 19/083* (2013.01); *G10L 19/038* (2013.01); *G10L 19/12* (2013.01); *G10L 2019/0003* (2013.01)

(58) Field of Classification Search
CPC ..... G10L 19/083; G10L 2019/0003

(Continued)

(56) References Cited

U.S. PATENT DOCUMENTS 5,450,449 A 9/1995 Kroon
5,560,449 A 10/1996 Smith (Continued)

FOREIGN PATENT DOCUMENTS

CN 1 121 683 4/2001
CN 1 321 297 11/2001

(Continued)

OTHER PUBLICATIONS

3GPP TS 26.190, "3rd Generation Partnership Project; Technical Specification Group Services and System Aspects; Speech codec speech processing functions; Adaptive Mult-Rate-Wideband (AMR-WB) speech codec; Transcording functions (Release 6)", v6.1.1 (Jul. 2005) 53 sheets.

(Continued)

*Primary Examiner* — Edwin S Leland, III
(74) *Attorney, Agent, or Firm* — Fay Kaplun & Marcin, LLP

(57) ABSTRACT

A device and method for quantizing a gain of a fixed contribution of an excitation in a frame, including sub-frames, of a coded sound signal, wherein the gain of the fixed excitation contribution is estimated in a sub-frame using a parameter representative of a classification of the frame. The gain of the fixed excitation contribution is then quantized in the sub-frame using the estimated gain. The device and method is used in jointly quantizing gains of adaptive and fixed contributions of an excitation in a frame of a coded sound signal. For retrieving a quantized gain of a fixed contribution of an excitation in a sub-frame of a frame, the gain of the fixed excitation contribution is estimated using a parameter representative of a classification of the frame, a gain codebook supplies a correction factor in response to a received, gain codebook index, and a multi- (Continued)

plier multiplies the estimated gain by the correction factor to provide a quantized gain of the fixed excitation contribution.

12 Claims, 6 Drawing Sheets

Related U.S. Application Data

No. 14/456,909, filed on Aug. 11, 2014, now Pat. No. 9,626,982, which is a division of application No. 13/396,371, filed on Feb. 14, 2012, now Pat. No. 9,076,443.

(60) Provisional application No. 61/442,960, filed on Feb. 15, 2011.

(51) Int. Cl.
*G10L 19/038* (2013.01)
*G10L 19/00* (2013.01)

(58) Field of Classification Search
USPC ..... 704/222, 223, 230, 233
See application file for complete search history.

(56) References Cited

U.S. PATENT DOCUMENTS 5,899,968 A * 5/1999 Navarro ..... G10L 19/10 704/220
5,953,697 A 9/1999 Lin et al.
5,963,898 A * 10/1999 Navarro ..... G10L 19/083 704/220
5,970,442 A 10/1999 Timmer
5,974,377 A * 10/1999 Navarro ..... G10L 19/09 704/201
6,014,621 A 1/2000 Chen
6,141,638 A 10/2000 Peng et al.
6,314,393 B1 11/2001 Zheng et al.
6,470,313 B1 10/2002 Ojala
6,636,829 B1 10/2003 Benyassine et al.
6,757,649 B1 6/2004 Gao et al.
6,782,360 B1 8/2004 Gao et al.
6,959,274 B1 10/2005 Gao et al.
6,961,698 B1 11/2005 Gao et al.
7,191,122 B1 * 3/2007 Gao ..... G10L 19/20 704/223
7,260,522 B2 8/2007 Gao et al.
7,587,315 B2 9/2009 Unno
7,660,712 B2 2/2010 Gao et al.
7,778,827 B2 8/2010 Jelinek et al.
8,010,351 B2 8/2011 Gao
8,195,246 B2 * 6/2012 Vitte ..... G10L 21/0208 381/92
8,504,117 B2 * 8/2013 Fox ..... G10L 21/0208 381/92
8,504,360 B2 * 8/2013 Pedersen ..... G10L 21/0208 381/73.1
8,620,647 B2 12/2013 Gao et al.
8,880,394 B2 * 11/2014 Parikh ..... G10L 21/0208 379/406.06
9,911,425 B2 * 3/2018 Malenovsky ..... G10L 19/083
2002/0123887 A1 9/2002 Unno
2003/0036901 A1 * 2/2003 Chen ..... G10L 19/005 704/230
2004/0260545 A1 12/2004 Gao et al.
2005/0071154 A1 * 3/2005 Etter ..... G10L 19/12 704/223
2005/0171771 A1 8/2005 Yasunaga et al.
2005/0251387 A1 11/2005 Jelinek et al.
2006/0271354 A1 * 11/2006 Sun ..... G10L 19/26 704/205
2007/0061137 A1 * 3/2007 Yang ..... G10L 19/005 704/222
2007/0147518 A1 * 6/2007 Bessette ..... G10L 19/0212 375/243
2007/0225971 A1 * 9/2007 Bessette ..... G10L 19/0208 704/203
2007/0282601 A1 12/2007 Li
2008/0154588 A1 6/2008 Gao
2008/0243489 A1 10/2008 Chamberlain
2009/0177464 A1 7/2009 Gao et al.
2009/0182558 A1 7/2009 Su et al.
2010/0241425 A1 * 9/2010 Eksler ..... G10L 19/12 704/220
2011/0054891 A1 * 3/2011 Vitte ..... H04R 3/005 704/233
2012/0209599 A1 * 8/2012 Malenovsky ..... G10L 19/083 704/219
2012/0253797 A1 * 10/2012 Geiger ..... G10L 19/083 704/219

FOREIGN PATENT DOCUMENTS

CN 1 457 485 11/2003
CN 1 468 427 1/2004
CN 1 151 492 5/2004
CN 1 245 706 3/2006
JP 2002 507011 3/2002
JP 2006 525533 11/2006
RU 2 257 556 7/2005
RU 2 262 748 10/2005
RU 2 316 059 1/2008
WO 2001/022402 3/2001
WO 2001/091112 11/2001
WO 2004/097797 11/2004

OTHER PUBLICATIONS

J. D. Johnston, "Transform Coding of Audio Signals Using Perceptual Noise Criteria", IEEE Journal on Selected Areas in Comm., vol. 6, No. 2, Feb. 1998, pp. 314-323.

Jelinek, et al., "Advances in source-controlled variable bitrate wideband speech coding", Special Workshop in Maui (SWIM): Lectures by masters in speech processing, Maui, Hawaii, Jan. 12-14, 2004, 13 sheets.

Jelinek, et al., "G. 718: A new embedded speech and audio coding standard with high resilience to error-prone transmission channels", IEEE Communications Magazine, vol. 47, Oct. 2009, pp. 117-123.

MacQueen, "Some methods for classification and analysis of multivariate observations", In Proceedings of 5th Berkeley Symposium on Mathematical Statistics and Probability, Berkeley, University of California Press, 1:281-297, 1967, 17 sheets.

* cited by examiner

DEVICE AND METHOD FOR QUANTIZING THE GAINS OF THE ADAPTIVE AND FIXED CONTRIBUTIONS OF THE EXCITATION IN A CELP CODEC

FIELD

The present disclosure relates to quantization of the gain of a fixed contribution of an excitation in a coded sound signal. The present disclosure also relates to joint quantization of the gains of the adaptive and fixed contributions of the excitation.

BACKGROUND

In a coder of a codec structure, for example a CELP (Code-Excited Linear Prediction) codec structure such as ACELP (Algebraic Code-Excited Linear Prediction), an input speech or audio signal (sound signal) is processed in short segments, called frames. In order to capture rapidly varying properties of an input sound signal, each frame is further divided into sub-frames. A CELP codec structure also produces adaptive codebook and fixed codebook contributions of an excitation that are added together to form a total excitation. Gains related to the adaptive and fixed codebook contributions of the excitation are quantized and transmitted to a decoder along with other encoding parameters. The adaptive codebook contribution and the fixed codebook contribution of the excitation will be referred to as "the adaptive contribution" and "the fixed contribution" of the excitation throughout the document.

DETAILED DESCRIPTION

Figure 1:
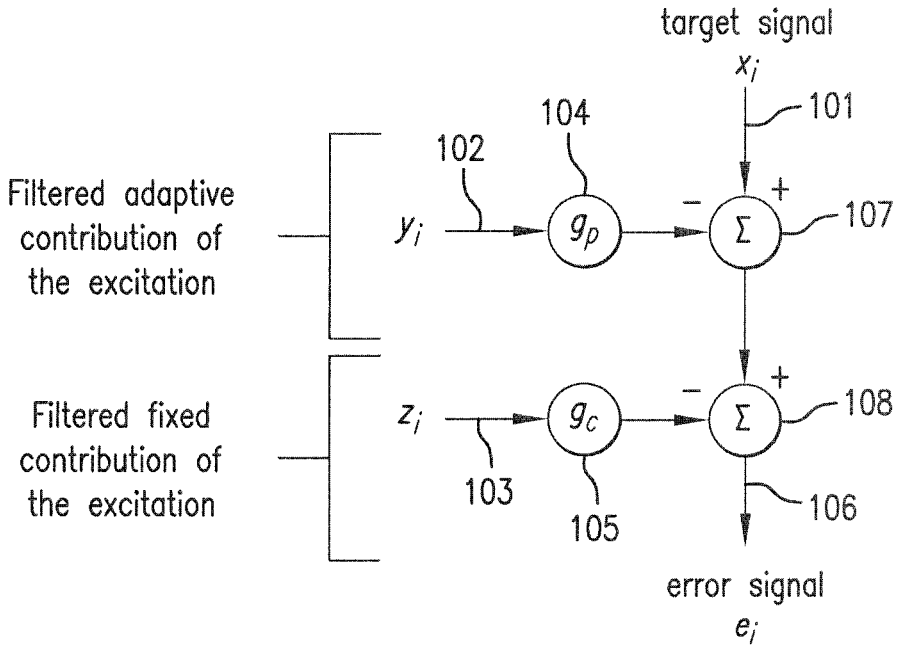
FIG. 1 is a schematic diagram describing the construction of a filtered excitation in a CELP-based coder.

According to a first aspect, the present disclosure relates to a device for quantizing a gain of a fixed contribution of an excitation in a frame, including sub-frames, of a coded sound signal, comprising: an input for a parameter representative of a classification of the frame; an estimator of the gain of the fixed contribution of the excitation in a sub-frame of the frame, wherein the estimator is supplied with the parameter representative of the classification of the frame; and a predictive quantizer of the gain of the fixed contribution of the excitation, in the sub-frame, using the estimated gain.

The present disclosure also relates to a method for quantizing a gain of a fixed contribution of an excitation in a frame, including sub-frames, of a coded sound signal, comprising: receiving a parameter representative of a classification of the frame;

estimating the gain of the fixed contribution of the excitation in a sub-frame of the frame, using the parameter representative of the classification of the frame; and predictive quantizing the gain of the fixed contribution of the excitation, in the sub-frame, using the estimated gain.

According to a third aspect, there is provided a device for jointly quantizing gains of adaptive and fixed contributions of an excitation in a frame of a coded sound signal, comprising: a quantizer of the gain of the adaptive contribution of the excitation; and the above described device for quantizing the gain of the fixed contribution of the excitation.

The present disclosure further relates to a method for jointly quantizing gains of adaptive and fixed contributions of an excitation in a frame of a coded sound signal, comprising: quantizing the gain of the adaptive contribution of the excitation; and quantizing the gain of the fixed contribution of the excitation using the above described method.

According to a fifth aspect, there is provided a device for retrieving a quantized gain of a fixed contribution of an excitation in a sub-frame of a frame, comprising: a receiver of a gain codebook index; an estimator of the gain of the fixed contribution of the excitation in the sub-frame, wherein the estimator is supplied with a parameter representative of a classification of the frame; a gain codebook for supplying a correction factor in response to the gain codebook index; and a multiplier of the estimated gain by the correction factor to provide a quantized gain of the fixed contribution of the excitation in the sub-frame.

The present disclosure is also concerned with a method for retrieving a quantized gain of a fixed contribution of an excitation in a sub-frame of a frame, comprising: receiving a gain codebook index; estimating the gain of the fixed contribution of the excitation in the sub-frame, using a parameter representative of a classification of the frame; supplying, from a gain codebook and for the sub-frame, a correction factor in response to the gain codebook index; and multiplying the estimated gain by the correction factor to provide a quantized gain of the fixed contribution of the excitation in said sub-frame.

The present disclosure is still further concerned with a device for retrieving quantized gains of adaptive and fixed contributions of an excitation in a sub-frame of a frame, comprising: a receiver of a gain codebook index; an estimator of the gain of the fixed contribution of the excitation in the sub-frame, wherein the estimator is supplied with a parameter representative of the classification of the frame; a gain codebook for supplying the quantized gain of the adaptive contribution of the excitation and a correction factor for the sub-frame in response to the gain codebook index; and a multiplier of the estimated gain by the correction factor to provide a quantized gain of fixed contribution of the excitation in the sub-frame.

According to a further aspect, the disclosure describes a method for retrieving quantized gains of adaptive and fixed contributions of an excitation in a sub-frame of a frame, comprising: receiving a gain codebook index; estimating the gain of the fixed contribution of the excitation in the sub-frame, using a parameter representative of a classification of the frame; supplying, from a gain codebook and for the sub-frame, the quantized gain of the adaptive contribution of the excitation and a correction factor in response to the gain codebook index; and multiplying the estimated gain by the correction factor to provide a quantized gain of fixed contribution of the excitation in the sub-frame.

There is a need for a technique for quantizing the gains of the adaptive and fixed excitation contributions that improve the robustness of the codec against frame erasures or packet losses that can occur during transmission of the encoding parameters from the coder to the decoder.

The foregoing and other features will become more apparent upon reading of the following non-restrictive description of illustrative embodiments, given by way of example only with reference to the accompanying drawings.

In the following, there is described quantization of a gain of a fixed contribution of an excitation in a coded sound signal, as well as joint quantization of gains of adaptive and fixed contributions of the excitation. The quantization can be applied to any number of sub-frames and deployed with any input speech or audio signal (input sound signal) sampled at any arbitrary sampling frequency. Also, the gains of the adaptive and fixed contributions of the excitation are quantized without the need of inter-frame prediction. The absence of inter-frame prediction results in improvement of the robustness against frame erasures or packet losses that can occur during transmission of encoded parameters.

The gain of the adaptive contribution of the excitation is quantized directly whereas the gain of the fixed contribution of the excitation is quantized through an estimated gain. The estimation of the gain of the fixed contribution of the excitation is based on parameters that exist both at the coder and the decoder. These parameters are calculated during processing of the current frame. Thus, no information from a previous frame is required in the course of quantization or decoding which, as mentioned hereinabove, improves the robustness of the codec against frame erasures.

Although the following description will refer to a CELP (Code-Excited Linear Prediction) codec structure, for example ACELP (Algebraic Code-Excited Linear Prediction), it should be kept in mind that the subject matter of the present disclosure may be applied to other types of codec structures.

Optimal Unquantized Gains for the Adaptive and Fixed Contributions of the Excitation In the art of CELP coding, the excitation is composed of two contributions: the adaptive contribution (adaptive codebook excitation) and the fixed contribution (fixed codebook excitation). The adaptive codebook is based on long-term prediction and is therefore related to the past excitation. The adaptive contribution of the excitation is found by means of a closed-loop search around an estimated value of a pitch lag. The estimated pitch lag is found by means of a correlation analysis. The closed-loop search consists of minimizing the mean square weighted error (MSWE) between a target signal (in CELP coding, a perceptually filtered version of the input speech or audio signal (input sound signal)) and the filtered adaptive contribution of the excitation scaled by an adaptive codebook gain. The filter in the closed-loop search corresponds to the weighted synthesis filter known in the art of CELP coding. A fixed codebook search is also carried out by minimizing the mean squared error (MSE) between an updated target signal (after removing the adaptive contribution of the excitation) and the filtered fixed contribution of the excitation scaled by a fixed codebook gain. The construction of the total filtered excitation is shown in FIG. 1. For further reference, an implementation of CELP coding is described in the following document: 3GPP TS 26.190, "Adaptive Multi-Rate-Wideband (AMR-WB) speech codec; Transcoding functions", of which the full contents is herein incorporated by reference.

FIG. 1 is a schematic diagram describing the construction of the filtered total excitation in a CELP coder. The input signal 101, formed by the above mentioned target signal, is denoted as x(i) and is used as a reference during the search of gains for the adaptive and fixed contributions of the excitation. The filtered adaptive contribution of the excitation is denoted as y(i) and the filtered fixed contribution of the excitation (innovation) is denoted as z(i). The corresponding gains are denoted as $g_p$ for the adaptive contribution and $g_c$ for the fixed contribution of the excitation. As illustrated in FIG. 1, an amplifier 104 applies the gain $g_p$ to the filtered adaptive contribution y(i) of the excitation and an amplifier 105 applies the gain $g_c$ to the filtered fixed contribution z(i) of the excitation. The optimal quantized gains are found by means of minimization of the mean square of the error signal e(i) calculated through a first subtractor 107 subtracting the signal $g_p y(i)$ at the output of the amplifier 104 from the target signal $x_t$ and a second subtractor 108 subtracting the signal $g_c z(i)$ at the output of the amplifier 105 from the result of the subtraction from the subtractor 107. For all signals in FIG. 1, the index i denotes the different signal samples and runs from 0 to L−1, where L is the length of each sub-frame. As well known to people skilled in the art, the filtered adaptive codebook contribution is usually computed as the convolution between the adaptive codebook excitation vector v(n) and the impulse response of the weighted synthesis filter h(n), that is y(n)=v(n)*h(n). Similarly, the filtered fixed codebook excitation z(n) is given by z(n)=c(n)*h(n), where c(n) is the fixed codebook excitation.

Assuming the knowledge of the target signal x(i), the filtered adaptive contribution of the excitation y(i) and the filtered fixed contribution of the excitation z(i), the optimal set of unquantized gains $g_p$ and $g_c$ is found by minimizing the energy of the error signal e(i) given by the following relation:

$$e(i)=x(i)-g_p y(i)-g_c z(i),\ i=0,\ldots,L-1 \tag{1}$$

Equation (1) can be given in vector form as $$e=x-g_p y-g_c z \tag{2}$$

and minimizing the energy of the error signal, $$e^t e=\sum_{i=0}^{L-1} e^2(i),$$

where t denotes vector transpose, results in optimum unquantized gains $$g_{p,opt}=\frac{c_1c_2-c_3c_4}{c_0c_2-c_4^2},\ g_{c,opt}=\frac{c_0c_3-c_1c_4}{c_0c_2-c_4^2} \tag{3}$$

where the constants or correlations $c_0$, $c_1$, $c_2$, $c_3$, $c_4$ and $c_5$ are calculated as $$c_0=y^ty,\ c_1=x^ty,\ c_2=z^tz,\ c_3=x^tz,\ c_4=y^tz,\ c_5=x^tx. \tag{4}$$

The optimum gains in Equation (3) are not quantized directly, but they are used in training a gain codebook as will be described later. The gains are quantized jointly, after applying prediction to the gain of the fixed contribution of the excitation. The prediction is performed by computing an estimated value of the gain $g_{c0}$ of the fixed contribution of the excitation. The gain of the fixed contribution of the excitation is given by $g_c=g_{c0}\cdot\gamma$ where γ is a correction factor. Therefore, each codebook entry contains two values. The first value corresponds to the quantized gain $g_p$ of the adaptive contribution of the excitation. The second value corresponds to the correction factor γ which is used to multiply the estimated gain $g_{c0}$ of the fixed contribution of the excitation. The optimum index in the gain codebook ($g_p$ and γ) is found by minimizing the mean squared error between the target signal and filtered total excitation. Estimation of the gain of the fixed contribution of the excitation is described in detail below.

Estimation of the Gain of the Fixed Contribution of the Excitation

Each frame contains a certain number of sub-frames. Let us denote the number of sub-frames in a frame as K and the index of the current sub-frame as k. The estimation $g_{c0}$ of the gain of the fixed contribution of the excitation is performed differently in each sub-frame.

Figure 2:
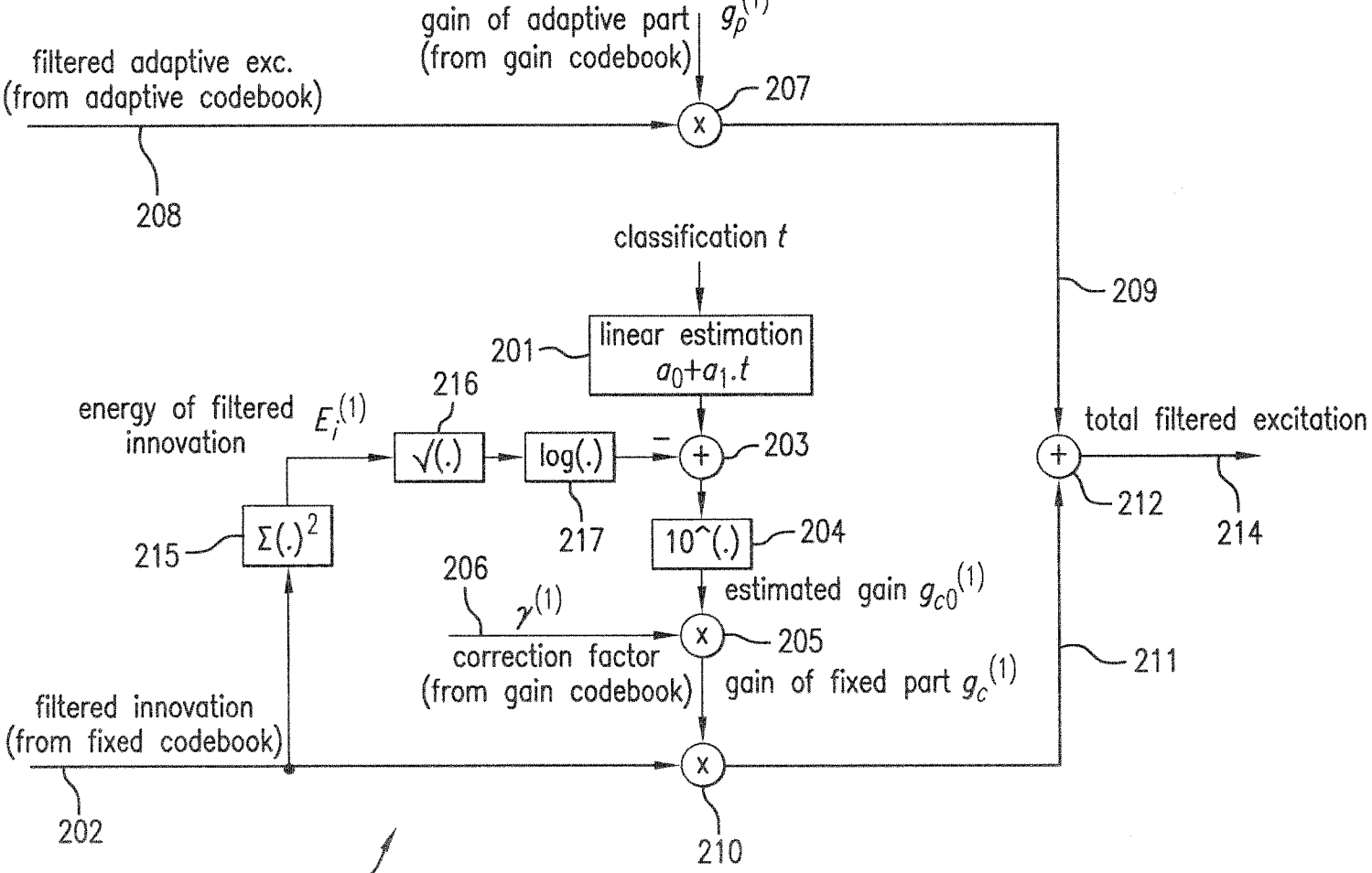
FIG. 2 is a schematic block diagram describing an estimator of the gain of the fixed contribution of the excitation in a first sub-frame of each frame.

FIG. 2 is a schematic block diagram describing an estimator 200 of the gain of the fixed contribution of the excitation (hereinafter fixed codebook gain) in a first sub-frame of each frame.

The estimator 200 first calculates an estimation of the fixed codebook gain in response to a parameter t representative of the classification of the current frame. The energy of the innovation codevector from the fixed codebook is then subtracted from the estimated fixed codebook gain to take into consideration this energy of the filtered innovation codevector. The resulting, estimated fixed codebook gain is multiplied by a correction factor selected from a gain codebook to produce the quantized fixed codebook gain $g_c$.

In one embodiment, the estimator 200 comprises a calculator 201 of a linear estimation of the fixed codebook gain in logarithmic domain. The fixed codebook gain is estimated assuming unity-energy of the innovation codevector 202 from the fixed codebook. Only one estimation parameter is used by the calculator 201, the parameter t representative of the classification of the current frame. A subtractor 203 then subtracts the energy of the filtered innovation codevector 202 from the fixed codebook in logarithmic domain from the linear estimated fixed codebook gain in logarithmic domain at the output of the calculator 201. A converter 204 converts the estimated fixed codebook gain in logarithmic domain from the subtractor 203 to linear domain. The output in linear domain from the converter 204 is the estimated fixed codebook gain $g_{c0}$. A multiplier 205 multiplies the estimated gain $g_{c0}$ by the correction factor 206 selected from the gain codebook. As described in the preceding paragraph, the output of the multiplier 205 constitutes the quantized fixed codebook gain $g_c$.

The quantized gain $g_p$ of the adaptive contribution of the excitation (hereinafter the adaptive codebook gain) is selected directly from the gain codebook. A multiplier 207 multiplies the filtered adaptive excitation 208 from the adaptive codebook by the quantized adaptive codebook gain $g_p$ to produce the filtered adaptive contribution 209 of the filtered excitation. Another multiplier 210 multiplies the filtered innovation codevector 202 from the fixed codebook by the quantized fixed codebook gain $g_c$ to produce the filtered fixed contribution 211 of the filtered excitation. Finally, an adder 212 sums the filtered adaptive 209 and fixed 211 contributions of the excitation to form the total filtered excitation 214.

In the first sub-frame of the current frame, the estimated fixed codebook gain in logarithmic domain at the output of the subtractor 203 is given by $$G_{c0}^{(1)}=a_0+a_1t-\log_{10}(\sqrt{E_i}) \quad (5)$$

where $G_{c0}^{(1)}=\log_{10}(g_{c0}^{(1)})$.

The inner term inside the logarithm of Equation (5) corresponds to the square root of the energy of the filtered innovation vector 202 ($E_i$ is the energy of the filtered innovation vector in the first sub-frame of frame n). This inner term (square root of the energy $E_i$) is determined by a first calculator 215 of the energy $E_i$ of the filtered innovation vector 202 and a calculator 216 of the square root of that energy $E_i$. A calculator 217 then computes the logarithm of the square root of the energy $E_i$ for application to the negative input of the subtractor 203. The inner term (square root of the energy $E_i$) has non-zero energy; the energy is incremented by a small amount in case of all-zero frames to avoid log(0).

The estimation of the fixed codebook gain in calculator 201 is linear in logarithmic domain with estimation coefficients $a_0$ and $a_1$ which are found for each sub-frame by means of a mean square minimization on a large signal database (training) as will be explained in the following description. The only estimation parameter 202 in the equation, t, denotes the classification parameter for frame n (in one embodiment, this value is constant for all sub-frames in frame n). Details about classification of the frames are given below. Finally, the estimated value of the gain in logarithmic domain is converted back to the linear domain ($g_{c0}^{(1)}=10^{G_{c0}^{(1)}}$) by the calculator 204 and used in the search process for the best index of the gain codebook as will be explained in the following description.

The superscript $^{(1)}$ denotes the first sub-frame of the current frame n.

As explained in the foregoing description, the parameter t representative of the classification of the current frame is used in the calculation of the estimated fixed codebook gain $g_{c0}$. Different codebooks can be designed for different classes of voice signals. However, this will increase memory requirements. Also, estimation of the fixed codebook gain in the frames following the first frame can be based on the frame classification parameter t and the available adaptive and fixed codebook gains from previous sub-frames in the current frame. The estimation is confined to the frame boundary to increase robustness against frame erasures.

For example, frames can be classified as unvoiced, voiced, generic, or transition frames. Different alternatives can be used for classification. An example is given later below as a non-limitative illustrative embodiment. Further, the number of voice classes can be different from the one used hereinabove. For example the classification can be only voiced or unvoiced in one embodiment. In another embodiment more classes can be added such as strongly voiced and strongly unvoiced.

The values for the classification estimation parameter t can be chosen arbitrarily. For example, for narrowband signals, the values of parameter t are set to: 1, 3, 5, and 7, for unvoiced, voiced, generic, and transition frames, respectively, and for wideband signals, they are set to 0, 2, 4, and 6, respectively. However, other values for the estimation parameter t can be used for each class. Including this estimation, classification parameter t in the design and training for determining estimation parameters will result in better estimation $g_{c0}$ of the fixed codebook gain.

The sub-frames following the first sub-frame in a frame use slightly different estimation scheme. The difference is in fact that in these sub-frames, both the quantized adaptive codebook gain and the quantized fixed codebook gain from the previous sub-frame(s) in the current frame are used as auxiliary estimation parameters to increase the efficiency.

Figure 3:
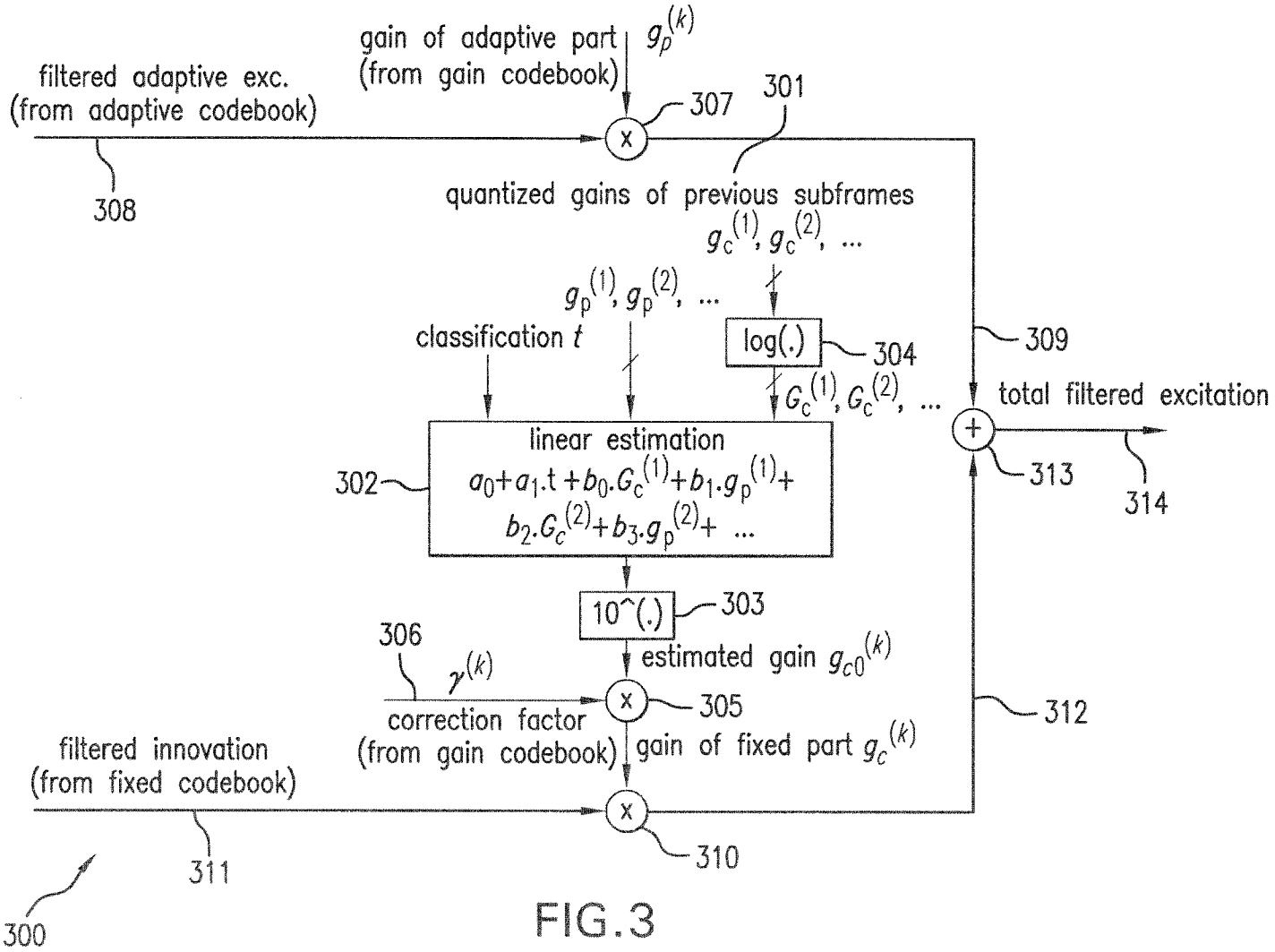
FIG. 3 is a schematic block diagram describing an estimator of the gain of the fixed contribution of the excitation in all sub-frames following the first sub-frame.

FIG. 3 is a schematic block diagram of an estimator 300 for estimating the fixed codebook gain in the sub-frames following the first sub-frame in a current frame. The estimation parameters include the classification parameter t and the quantized values (parameters 301) of both the adaptive and fixed codebook gains from previous sub-frames of the current frame. These parameters 301 are denoted as $g_p^{(1)}$, $g_c^{(1)}$, $g_p^{(2)}$, $g_p^{(2)}$, etc. where the superscript refers to first, second and other previous sub-frames. An estimation of the fixed codebook gain is calculated and is multiplied by a correction factor selected from the gain codebook to produce a quantized fixed codebook gain $g_c$, forming the gain of the fixed contribution of the excitation (this estimated fixed codebook gain is different from that of the first sub-frame).

In one embodiment, a calculator 302 computes a linear estimation of the fixed codebook gain again in logarithmic domain and a converter 303 converts the gain estimation back to linear domain. The quantized adaptive codebook gains $g_p^{(1)}$, $g_p^{(2)}$, etc. from the previous sub-frames are supplied to the calculator 302 directly while the quantized fixed codebook gains $g_c^{(1)}$, $g_c^{(2)}$, etc. from the previous sub-frames are supplied to the calculator 302 in logarithmic domain through a logarithm calculator 304. A multiplier 305 then multiplies the estimated fixed codebook gain $g_{c0}$ (which is different from that of the first sub-frame) from the converter 303 by the correction factor 306, selected from the gain codebook. As described in the preceding paragraph, the multiplier 305 then outputs a quantized fixed codebook gain $g_c$, forming the gain of the fixed contribution of the excitation.

A first multiplier 307 multiplies the filtered adaptive excitation 308 from the adaptive codebook by the quantized adaptive codebook gain $g_p$ selected directly from the gain codebook to produce the adaptive contribution 309 of the excitation. A second multiplier 310 multiplies the filtered innovation codevector 311 from the fixed codebook by the quantized fixed codebook gain $g_c$ to produce the fixed contribution 312 of the excitation. An adder 313 sums the filtered adaptive 309 and filtered fixed 312 contributions of the excitation together so as to form the total filtered excitation 314 for the current frame.

The estimated fixed codebook gain from the calculator 302 in the $k^{th}$ sub-frame of the current frame in logarithmic domain is given by $$G_{c0}^{(k)}=a_0+a_1t+\Sigma_{j=1}^{k-1}(b_{2j-2}G_c^{(j)}+b_{2j-1}g_p^{(j)}),\ k=2,\ldots,K. \tag{6}$$

where $G_c^{(k)}=\log_{10}(g_c^{(k)})$ is the quantized fixed codebook gain in logarithmic domain in sub-frame k, and $g_p^{(k)}$ is the quantized adaptive codebook gain in sub-frame k.

For example, in one embodiment, four (4) sub-frames are used (K=4) so the estimated fixed codebook gains, in logarithmic domain, in the second, third, and fourth sub-frames from the calculator 302 are given by the following relations:

$$G_{c0}^{(2)}=a_0+a_1t+b_0G_c^{(1)}+b_1g_p^{(1)},$$

$$G_{c0}^{(3)}=a_0+a_1t+b_0G_c^{(1)}+b_1g_p^{(1)}+b_2G_c^{(2)}+b_3g_p^{(2)},\text{ and}$$

$$G_{c0}^{(4)}=a_0+a_1t+b_0G_c^{(1)}+b_1g_p^{(1)}+b_2G_c^{(2)}+b_3g_p^{(2)}+b_4G_c^{(3)}+b_5g_p^{(3)}.$$

The above estimation of the fixed codebook gain is based on both the quantized adaptive and fixed codebook gains of all previous sub-frames of the current frame. There is also another difference between this estimation scheme and the one used in the first sub-frame. The energy of the filtered innovation vector from the fixed codebook is not subtracted from the linear estimation of the fixed codebook gain in the logarithmic domain from the calculator 302. The reason comes from the use of the quantized adaptive codebook and fixed codebook gains from the previous sub-frames in the estimation equation. In the first sub-frame, the linear estimation is performed by the calculator 201 assuming unit energy of the innovation vector. Subsequently, this energy is subtracted to bring the estimated fixed codebook gain to the same energetic level as its optimal value (or at least close to it). In the second and subsequent sub-frames, the previous quantized values of the fixed codebook gain are already at this level so there is no need to take the energy of the filtered innovation vector into consideration. The estimation coefficients $a_1$ and $b_i$ are different for each sub-frame and they are determined offline using a large training database as will be described later below.

Calculation of Estimation Coefficients

An optimal set of estimation coefficients is found on a large database containing clean, noisy and mixed speech signals in various languages and levels and with male and female talkers.

The estimation coefficients are calculated by running the codec with optimal unquantized values of adaptive and fixed codebook gains on the large database. It is reminded that the optimal unquantized adaptive and fixed codebook gains are found according to Equations (3) and (4).

In the following description it is assumed that the database comprises N+1 frames, and the frame index is n=0, . . . , N. The frame index n is added to the parameters used in the training which vary on a frame basis (classification, first sub-frame innovation energy, and optimum adaptive and fixed codebook gains).

The estimation coefficients are found by minimizing the mean square error between the estimated fixed codebook gain and the optimum gain in the logarithmic domain over all frames in the database.

For the first sub-frame, the mean square error energy is given by $$E_{est}^{(1)}=\sum_{n=0}^{N}[G_{c0}^{(1)}(n)-\log_{10}(g_{c,opt}^{(1)}(n))]^2 \tag{7}$$

From Equation (5), the estimated fixed codebook gain in the first sub-frame of frame n is given by $$G_{c0}^{(1)}(n)=a_0+a_1t(n)-\log_{10}(\sqrt{E_i(n)}),$$

then the mean square error energy is given by $$E_{est}^{(1)}\sum_{n=0}^{N}\left[a_0+a_1t(n)-\log_{10}\left(\sqrt{E_i^{(1)}(n)}\right)-\log_{10}(g_{c,opt}^{(1)}(n))\right]^2. \tag{8}$$

In above equation above (8), $E_{est}$ is the total energy (on the whole database) of the error between the estimated and optimal fixed codebook gains, both in logarithmic domain. The optimal, fixed codebook gain in the first sub-frame is denoted $g^{(1)}_{c,opt}$. As mentioned in the foregoing description, $E_i(n)$ is the energy of the filtered innovation vector from the fixed codebook and t(n) is the classification parameter of frame n. The upper index $^{(1)}$ is used to denote the first sub-frame and n is the frame index.

The minimization problem may be simplified by defining a normalized gain of the innovation vector in logarithmic domain. That is $$G_i^{(1)}(n)=\log_{10}(\sqrt{E_i^{(1)}(n)})+\log_{10}(g_{c,opt}^{(1)}(n)),\ n=0,\ldots,N-1. \tag{9}$$

The total error energy then becomes $$E_{est}^{(1)} = \sum_{n=0}^{N} [a_0 + a_1 t(n) - G_i^{(1)}(n)]^2. \tag{10}$$

The solution of the above defined MSE (Mean Square Error) problem is found by the following pair of partial derivatives $$\frac{\partial}{\partial a_0} E_{est}^{(1)} = 0, \ \frac{\partial}{\partial a_1} E_{est}^{(1)} = 0.$$

The optimal values of estimation coefficients resulting from the above equations are given by $$a_0 = \frac{\sum_{n=0}^{N} t^2(n) \sum_{n=0}^{N} G_i^{(1)}(n) - \sum_{n=0}^{N} t(n) \sum_{n=0}^{N} t(n) G_i^{(1)}(n)}{N \sum_{n=0}^{N} t^2(n) + \left[\sum_{n=0}^{N} t(n)\right]^2}, \tag{11}$$

$$a_1 = \frac{N \sum_{n=0}^{N} t(n) G_i^{(1)}(n) - \sum_{n=0}^{N} t(n) \sum_{n=0}^{N} G_i^{(1)}(n)}{N \sum_{n=0}^{N} t^2(n) + \left[\sum_{n=0}^{N} t(n)\right]^2}.$$

Estimation of the fixed codebook gain in the first sub-frame is performed in logarithmic domain and the estimated fixed codebook gain should be as close as possible to the normalized gain of the innovation vector in logarithmic domain, $G_i^{(1)}(n)$.

For the second and other subsequent sub-frames, the estimation scheme is slightly different. The error energy is given by $$E_{est}^{(k)} = \sum_{n=0}^{N} [G_{c0}^{(k)}(n) - G_{c,opt}^{(k)}(n)]^2, \ k = 2, \ldots, K. \tag{12}$$

where $G_{c,opt}^{(k)} = \log_{10}(g_{c,opt}^{(k)})$. Substituting Equation (6) into Equation (12) the following is obtained $$E_{est}^{(k)} = \sum_{n=0}^{N} \left[a_0 + a_1 t(n) + \sum_{j=1}^{k-1} (b_{2j-2} G_c^{(j)}(n) + b_{2j-1} g_p^{(j)}(n)) - G_{c,opt}^{(k)}(n)\right]^2 \tag{13}$$

For the calculation of the estimation coefficients in the second and subsequent sub-frames of each frame, the quantized values of both the fixed and adaptive codebook gains of previous sub-frames are used in the above Equation (13). Although it is possible to use the optimal unquantized gains in their place, the usage of quantized values leads to the maximum estimation efficiency in all sub-frames and consequently to better overall performance of the gain quantizer.

Thus, the number of estimation coefficients increases as the index of the current sub-frame is advanced. The gain quantization itself is described in the following description. The estimation coefficients $a_i$ and $b_i$ are different for each sub-frame, but the same symbols were used for the sake of simplicity. Normally, they would either have the superscript $^{(k)}$ associated therewith or they would be denoted differently for each sub-frame, wherein k is the sub-frame index.

The minimization of the error function in Equation (13) leads to the following system of linear equations $$\begin{bmatrix} N & \sum_{n=0}^{N} t(n) & \ldots & \sum_{n=0}^{N} g_p^{(k-1)}(n) \\ \sum_{n=0}^{N} t(n) & \sum_{n=0}^{N} t^2(n) & \ldots & \sum_{n=0}^{N} t(n) g_p^{(k-1)}(n) \\ \vdots & \vdots & \ddots & \vdots \\ \sum_{n=0}^{N} g_p^{(k-1)}(n) & \sum_{n=0}^{N} t(n) g_p^{(k-1)}(n) & \ldots & \sum_{n=0}^{N} [g_p^{(k-1)}(n)]^2 \end{bmatrix} \begin{bmatrix} a_0 \\ a_1 \\ \vdots \\ b_{2k-3} \end{bmatrix} = \begin{bmatrix} \sum_{n=0}^{N} G_{c,opt}^{(k)}(n) \\ \sum_{n=0}^{N} t(n) G_{c,opt}^{(k)}(n) \\ \vdots \\ \sum_{n=0}^{N} g_p^{(k-1)}(n) G_{c,opt}^{(k)}(n) \end{bmatrix} \tag{14}$$

The solution of this system, i.e. the optimal set of estimation coefficients $a_0, a_1, b_0, \ldots, b_{2k-3}$, is not provided here as it leads to complicated formulas. It is usually solved by mathematical software equipped with a linear equation solver, for example MATLAB. This is advantageously done offline and not during the encoding process.

For the second sub-frame, Equation (14) reduces to $$\begin{bmatrix} N & \sum_{n=0}^{N} t(n) & \sum_{n=0}^{N} G_c^{(1)}(n) & \sum_{n=0}^{N} g_p^{(1)}(n) \\ \sum_{n=0}^{N} t(n) & \sum_{n=0}^{N} t^2(n) & \sum_{n=0}^{N} t(n) G_c^{(1)}(n) & \sum_{n=0}^{N} t(n) g_p^{(1)}(n) \\ \sum_{n=0}^{N} G_c^{(1)}(n) & \sum_{n=0}^{N} t(n) G_c^{(1)}(n) & \sum_{n=0}^{N} [G_c^{(1)}(n)]^2 & \sum_{n=0}^{N} G_c^{(1)}(n) g_p^{(1)}(n) \\ \sum_{n=0}^{N} g_p^{(1)}(n) & \sum_{n=0}^{N} t(n) g_p^{(1)}(n) & \sum_{n=0}^{N} G_c^{(1)}(n) g_p^{(1)}(n) & \sum_{n=0}^{N} [g_p^{(1)}(n)]^2 \end{bmatrix} \cdot \begin{bmatrix} a_0 \\ a_1 \\ b_0 \\ b_1 \end{bmatrix} = \begin{bmatrix} \sum_{n=0}^{N} G_{c,opt}^{(2)}(n) \\ \sum_{n=0}^{N} t(n) G_{c,opt}^{(2)}(n) \\ \sum_{n=0}^{N} G_c^{(1)}(n) G_{c,opt}^{(2)}(n) \\ \sum_{n=0}^{N} g_p^{(1)}(n) G_{c,opt}^{(2)}(n) \end{bmatrix}$$

Figure 4:
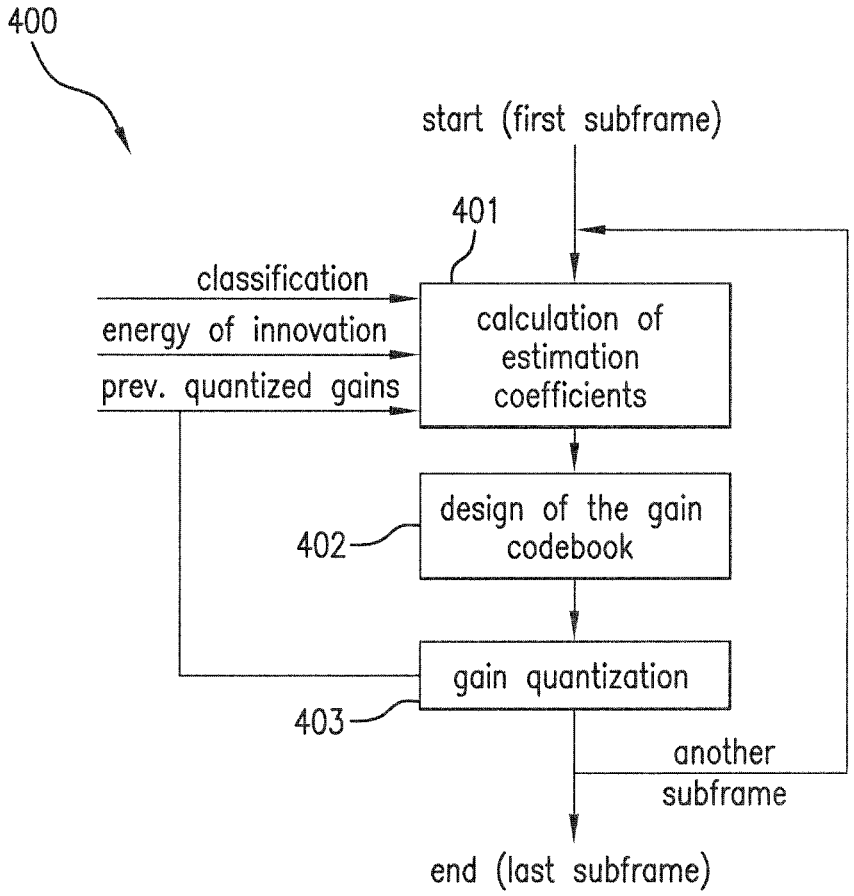
FIG. 4 is a schematic block diagram describing a state machine in which estimation coefficients are calculated and used for designing a gain codebook for each sub-frame.

As mentioned hereinabove, calculation of the estimation coefficients is alternated with gain quantization as depicted in FIG. 4. More specifically, FIG. 4 is a schematic block diagram describing a state machine 400 in which the estimation coefficients are calculated (401) for each sub-frame. The gain codebook is then designed (402) for each sub-frame using the calculated estimation coefficients. Gain quantization (403) for the sub-frame is then conducted on the basis of the calculated estimation coefficients and the gain codebook design. Estimation of the fixed codebook gain itself is slightly different in each sub-frame, the estimation coefficients are found by means of minimum mean square error, and the gain codebook may be designed by using the KMEANS algorithm as described, for example, in MacQueen, J. B. (1967). "Some Methods for classification and Analysis of Multivariate Observations". Proceedings of 5th Berkeley Symposium on Mathematical Statistics and Probability. University of California Press. pp. 281-297, of which the full contents is herein incorporated by reference.

Gain Quantization

Figure 5:
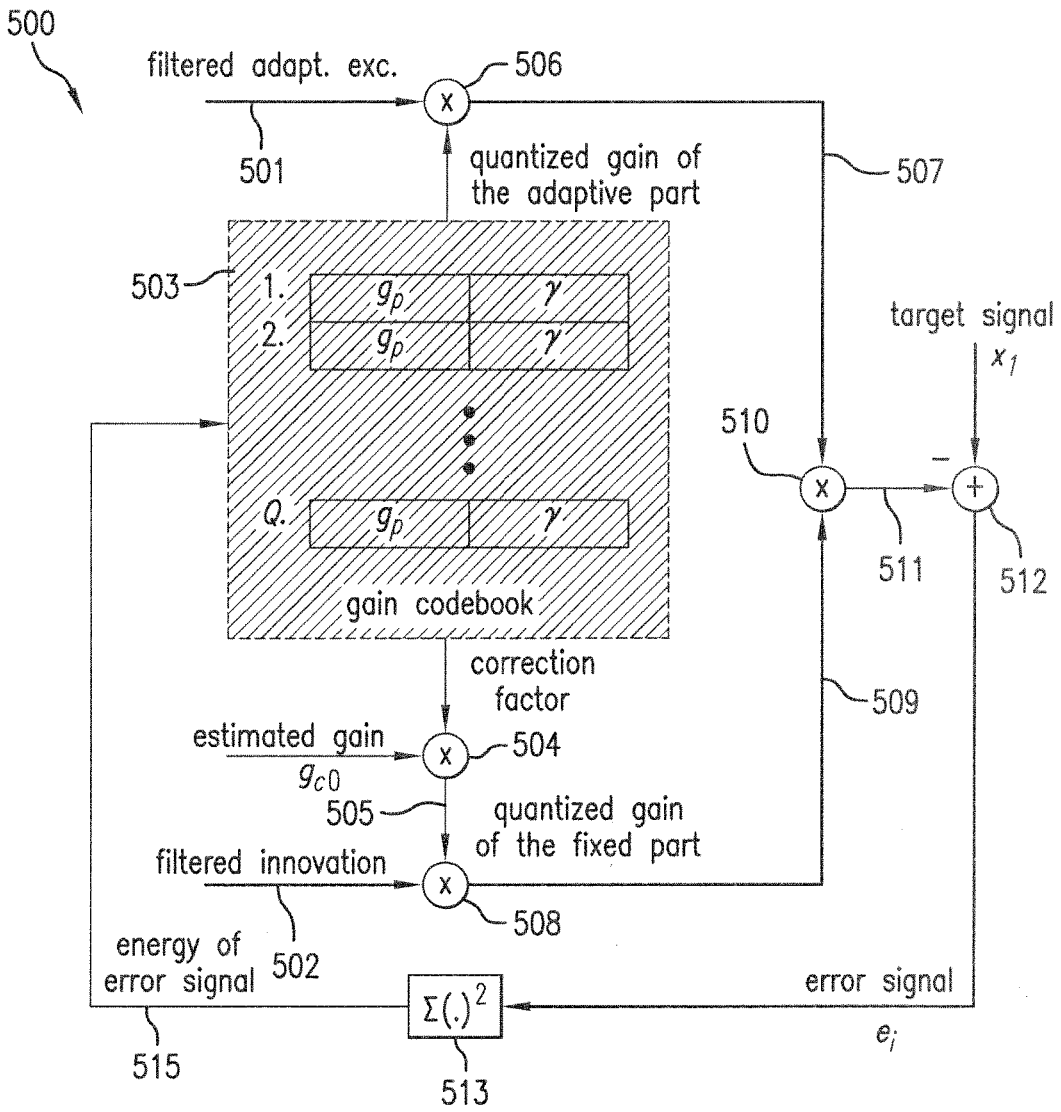
FIG. 5 is a schematic block diagram describing a gain quantizer.

FIG. 5 is a schematic block diagram describing a gain quantizer 500.

Before gain quantization it is assumed that both the filtered adaptive excitation 501 from the adaptive codebook and the filtered innovation codevector 502 from the fixed codebook are already known. The gain quantization at the coder is performed by searching the designed gain codebook 503 in the MMSE (Minimum Mean Square Error) sense. As described in the foregoing description, each entry in the gain codebook 503 includes two values: the quantized adaptive codebook gain $g_p$ and the correction factor $\gamma$ for the fixed contribution of the excitation. The estimation of the fixed codebook gain is performed beforehand and the estimated fixed codebook gain $g_{c0}$ is used to multiply the correction factor $\gamma$ selected from the gain codebook 503. In each sub-frame, the gain codebook 503 is searched completely, i.e. for indices q=0, . . . , Q−1, Q being the number of indices of the gain codebook. It is possible to limit the search range in case the quantized adaptive codebook gain $g_p$ is mandated to be below a certain threshold. To allow reducing the search range, the codebook entries may be sorted in ascending order according to the value of the adaptive codebook gain $g_p$.

Referring to FIG. 5, the two-entry gain codebook 503 is searched and each index provides two values—the adaptive codebook gain $g_p$ and the correction factor $\gamma$. A multiplier 504 multiplies the correction factor $\gamma$ by the estimated fixed codebook gain $g_{c0}$ and the resulting value is used as the quantized gain 505 of the fixed contribution of the excitation (quantized fixed codebook gain). Another multiplier 506 multiplies the filtered adaptive excitation 505 from the adaptive codebook by the quantized adaptive codebook gain $g_p$ from the gain codebook 503 to produce the adaptive contribution 507 of the excitation. A multiplier 508 multiplies the filtered innovation codevector 502 by the quantized fixed codebook gain 505 to produce the fixed contribution 509 of the excitation. An adder 510 sums both the adaptive 507 and fixed 509 contributions of the excitation together so as to form the filtered total excitation 511. A subtractor 512 subtracts the filtered total excitation 511 from the target signal $x_i$ to produce the error signal $e_i$. A calculator 513 computes the energy 515 of the error signal $e_i$ and supplies it back to the gain codebook searching mechanism. All or a subset of the indices of the gain codebook 501 are searched in this manner and the index of the gain codebook 503 yielding the lowest error energy 515 is selected as the winning index and sent to the decoder.

The gain quantization can be performed by minimizing the energy of the error in Equation (2). The energy is given by $$E=e^te=(x-g_py-g_cz)^t(x-g_py-g_cz). \tag{15}$$

Substituting $g_c$ by $\gamma g_{c0}$ the following relation is obtained $$E=c_5+g_p^2c_0-2g_pc_1+\gamma^2g_{c0}^2c_2-2\gamma g_{c0}c_3+2g_p\gamma g_{c0}c_4 \tag{16}$$

where the constants or correlations $c_0$, $c_2$ $c_3$, $c_4$ and $c_5$ are calculated as in Equation (4) above. The constants or correlations $c_0$, $c_1$, $c_2$, $c_3$, $c_4$ and $c_5$, and the estimated gain $g_c$o are computed before the search of the gain codebook 503, and then the energy in Equation (16) is calculated for each codebook index (each set of entry values $g_p$ and $\gamma$).

The codevector from the gain codebook 503 leading to the lowest energy 515 of the error signal $e_i$ is chosen as the winning codevector and its entry values correspond to the quantized values $g_p$ and $\gamma$. The quantized value of the fixed codebook gain is then calculated as $$g_c=g_{c0}\cdot\gamma.$$

Figure 6:
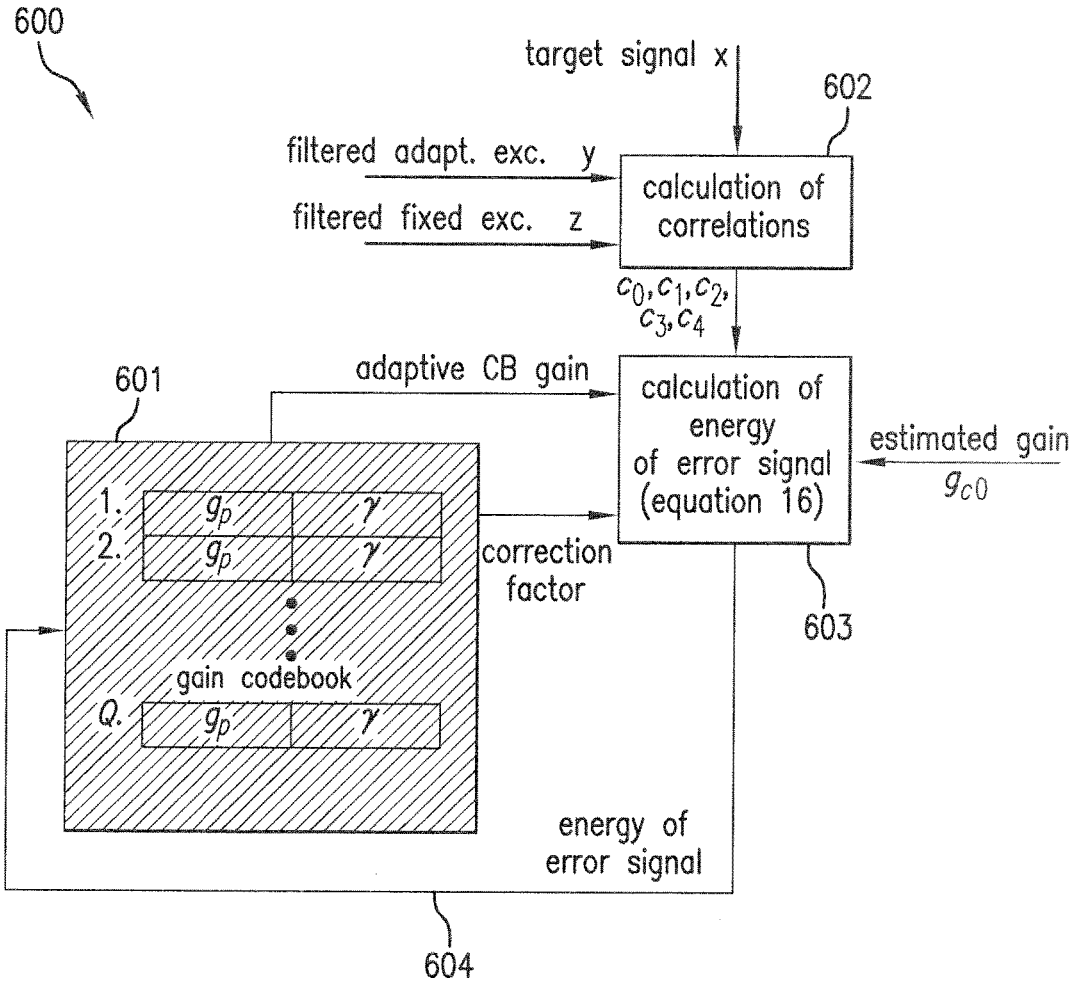
FIG. 6 is a schematic block diagram of another embodiment of gain quantizer equivalent to the gain quantizer of FIG. 5.

FIG. 6 is a schematic block diagram of an equivalent gain quantizer 600 as in FIG. 5, performing calculation of the energy $E_i$ of the error signal $e_i$ using Equation (16). More specifically, the gain quantizer 600 comprises a gain codebook 601, a calculator 602 of constants or correlations, and a calculator 603 of the energy 604 of the error signal. The calculator 602 calculates the constants or correlations $c_0$, $c_1$, $c_2$ $c_3$, $c_4$ and $c_5$ using Equation (4) and the target vector x, the filtered adaptive excitation vector y from the adaptive codebook, and the filtered fixed codevector z from the fixed codebook, wherein t denotes vector transpose. The calculator 603 uses Equation (16) to calculate the energy $E_1$ of the error signal $e_i$ from the estimated fixed codebook gain $g_{c0}$, the correlations $c_0$, $c_1$, $c_2$ $c_3$, $c_4$ and $c_5$ from calculator 602, and the quantized adaptive codebook gain $g_p$ and the correction factor $\gamma$ from the gain codebook 601. The energy 604 of the error signal from the calculator 603 is supplied back to the gain codebook searching mechanism. Again, all or a subset of the indices of the gain codebook 601 are searched in this manner and the index of the gain codebook 601 yielding the lowest error energy 604 is selected as the winning index and sent to the decoder.

In the gain quantizer 600 of FIG. 6, the gain codebook 601 has a size that can be different depending on the sub-frame. Better estimation of the fixed codebook gain is attained in later sub-frames in a frame due to increased number of estimation parameters. Therefore a smaller number of bits can be used in later sub-frames. In one embodiment, four (4) sub-frames are used where the numbers of bits for the gain codebook are 8, 7, 6, and 6 corresponding to sub-frames 1, 2, 3, and 4, respectively. In another embodiment at a lower bit rate, 6 bits are used in each sub-frame.

In the decoder, the received index is used to retrieve the values of quantized adaptive codebook gain $g_p$ and correction factor $\gamma$ from the gain codebook. The estimation of the fixed codebook gain is performed in the same manner as in the coder, as described in the foregoing description. The quantized value of the fixed codebook gain is calculated by the equation $g_c=g_{c0}\cdot\gamma$. Both the adaptive codevector and the innovation codevector are decoded from the bitstream and they become adaptive and fixed excitation contributions that are multiplied by the respective adaptive and fixed codebook gains. Both excitation contributions are added together to form the total excitation. The synthesis signal is found by filtering the total excitation through a LP synthesis filter as known in the art of CELP coding.

Signal Classification

Different methods can be used for determining classification of a frame, for example parameter t of FIG. 1. A non-limitative example is given in the following description where frames are classified as unvoiced, voiced, generic, or transition frames. However, the number of voice classes can be different from the one used in this example. For example the classification can be only voiced or unvoiced in one embodiment. In another embodiment more classes can be added such as strongly voiced and strongly unvoiced.

Signal classification can be performed in three steps, where each step discriminates a specific signal class. First, a signal activity detector (SAD) discriminates between active and inactive speech frames. If an inactive speech frame is detected (background noise signal) then the classification chain ends and the frame is encoded with comfort noise generation (CNG). If an active speech frame is detected, the frame is subjected to a second classifier to discriminate unvoiced frames. If the classifier classifies the frame as unvoiced speech signal, the classification chain ends, and the frame is encoded using a coding method optimized for unvoiced signals. Otherwise, the frame is processed through a "stable voiced" classification module. If the frame is classified as stable voiced frame, then the frame is encoded using a coding method optimized for stable voiced signals. Otherwise, the frame is likely to contain a non-stationary signal segment such as a voiced onset or rapidly evolving voiced signal. These frames typically require a general purpose coder and high bit rate for sustaining good subjective quality. The disclosed gain quantization technique has been developed and optimized for stable voiced and general-purpose frames. However, it can be easily extended for any other signal class.

In the following, the classification of unvoiced and voiced signal frames will be described.

The unvoiced parts of the sound signal are characterized by missing periodic component and can be further divided into unstable frames, where energy and spectrum change rapidly, and stable frames where these characteristics remain relatively stable. The classification of unvoiced frames uses the following parameters:

- voicing measure $\bar{r}_x$, computed as an averaged normalized correlation;
- average spectral tilt measure ($\bar{e}_t$)
- maximum short-time energy increase at low level ($\bar{e}_t$) to efficiently detect explosive signal segments;
- maximum short-time energy variation (dE) used to assess frame stability;
- tonal stability to discriminate music from unvoiced signal as described in [Jelinek, M., Vaillancourt, T., Gibbs, J., "G.718: A new embedded speech and audio coding standard with high resilience to error-prone transmission channels", *In IEEE Communications Magazine*, vol. 47, pp. 117-123, October 2009] of which the full contents is herein incorporated by reference; and
- relative frame energy ($E_{rel}$) to detect very low-energy signals.

Voicing Measure

The normalized correlation, used to determine the voicing measure, is computed as part of the open-loop pitch analysis. In the art of CELP coding, the open-loop search module usually outputs two estimates per frame. Here, it is also used to output the normalized correlation measures. These normalized correlations are computed on a weighted signal and a past weighted signal at the open-loop pitch delay. The weighted speech signal $s_w(n)$ is computed using a perceptual weighting filter. For example, a perceptual weighting filter with fixed denominator, suited for wideband signals, is used. An example of a transfer function of the perceptual weighting filter is given by the following relation:

$$W(z) = \frac{A(z/\gamma_1)}{1-\gamma_2 z^{-1}}, \text{ where } 0 < \gamma_2 < \gamma_1 \leq 1$$

where A(z) is a transfer function of linear prediction (LP) filter computed by means of the Levinson-Durbin algorithm and is given by the following relation $$A(z) = 1 + \sum_{i=1}^{p} a_i z^{-i}.$$

LP analysis and open-loop pitch analysis are well known in the art of CELP coding and, accordingly, will not be further described in the present description.

The voicing measure $\bar{r}_x$ is defined as an average normalized correlation given by the following relation:

$$\bar{C}_{norm} = \tfrac{1}{3}(C_{norm}(d_0)+C_{norm}(d_1)+C_{norm}(d_2))$$

where $C_{norm}(d_0)$, $C_{norm}(d_1)$ and $C_{norm}(d_2)$ are, respectively, the normalized correlation of the first half of the current frame, the normalized correlation of the second half of the current frame, and the normalized correlation of the look-ahead (the beginning of the next frame). The arguments to the correlations are the open-loop pitch lags.

Spectral Tilt

The spectral tilt contains information about a frequency distribution of energy. The spectral tilt can be estimated in the frequency domain as a ratio between the energy concentrated in low frequencies and the energy concentrated in high frequencies. However, it can be also estimated in different ways such as a ratio between the two first autocorrelation coefficients of the signal.

The energy in high frequencies and low frequencies is computed following the perceptual critical bands as described in [J. D. Johnston, "Transform Coding of Audio Signals Using Perceptual Noise Criteria," IEEE Journal on Selected Areas in Communications, vol. 6, no. 2, pp. 314-323, February 1988] of which the full contents is herein incorporated by reference. The energy in high frequencies is calculated as the average energy of the last two critical bands using the following relation:

$$\bar{E}_h = 0.5[E_{CB}(b_{max}-1)+E_{CB}(b_{max})]$$

where $E_{CB}(i)$ is the critical band energy of ith band and $b_{max}$ is the last critical band. The energy in low frequencies is computed as average energy of the first 10 critical bands using the following relation:

$$\bar{E}_l = \frac{1}{10-b_{min}} \sum_{i=b_{min}}^{9} E_{CB}(i)$$

where $b_{min}$ is the first critical band.

The middle critical bands are excluded from the calculation as they do not tend to improve the discrimination between frames with high energy concentration in low frequencies (generally voiced) and with high energy concentration in high frequencies (generally unvoiced). In between, the energy content is not characteristic for any of the classes discussed further and increases the decision confusion.

The spectral tilt is given by $$e_t = \frac{\overline{E}_l - \overline{N}_l}{\overline{E}_h - \overline{N}_h}$$

where $\overline{N}_h$ and $\overline{N}_l$ are, respectively, the average noise energies in the last two critical bands and first 10 critical bands, computed in the same way as $\overline{E}_h$ and $\overline{E}_l$. The estimated noise energies have been added to the tilt computation to account for the presence of background noise. The spectral tilt computation is performed twice per frame and average spectral tilt is calculated which is then used in unvoiced frame classification. That is $$\overline{e}_l = \tfrac{1}{3}(e_{old} + e_l(0) + e_l(1)),$$

where $e_{old}$ is the spectral tilt in the second half of the previous frame.

Maximum Short-Time Energy Increase at Low Level

The maximum short-time energy increase at low level dE0 is evaluated on the input sound signal s(n), where n=0 corresponds to the first sample of the current frame. Signal energy is evaluated twice per sub-frame. Assuming for example the scenario of four sub-frames per frame, the energy is calculated 8 times per frame. If the total frame length is, for example, 256 samples, each of these short segments may have 32 samples. In the calculation, short-term energies of the last 32 samples from the previous frame and the first 32 samples from the next frame are also taken into consideration. The short-time energies are calculated using the following relations:

$$E_{st}^{(1)}(j) = \max_{i=0}^{31}(s^2(i+32j)),\ j=-1,\ldots,8,$$

where j=−1 and j=8 correspond to the end of the previous frame and the beginning of the next frame, respectively. Another set of nine short-term energies is calculated by shifting the signal indices in the previous equation by 16 samples using the following relation:

$$E_{st}^{(2)}(j) = \max_{i=0}^{31}(s^2(i+32j-16)),\ j=0,\ldots,8.$$

For energies that are sufficiently low, i.e. which fulfill the condition $10\log(E_{st}^{(\bullet)}(j))<37$, the following ratio is calculated $$rat^{(1)}(j) = \frac{E_{st}^{(1)}(j+1)}{E_{st}^{(1)}(j)},\ \text{for}\ j=-1,\ldots,6,$$

for the first set of energies and the same calculation is repeated for $E_{st}^{(2)}(j)$ with j=0, . . . , 7 to obtain two sets of ratios $rat^{(1)}$ and $rat^{(2)}$. The only maximum in these two sets is searched by $$dE0 = \max(rat^{(1)}, rat^{(2)})$$

which is the maximum short-time energy increase at low level.

Maximum Short-Time Energy Variation

This parameter dE is similar to the maximum short-time energy increase at low level with the difference that the low-level condition is not applied. Thus, the parameter is computed as the maximum of the following four values:

$$E_{st}^{(1)}(0)/E_{st}^{(1)}(-1)$$

$$E_{st}^{(1)}(7)/E_{st}^{(1)}(8)$$

$$\frac{\max(E_{st}^{(1)}(j), E_{st}^{(1)}(j-1))}{\min(E_{st}^{(1)}(j), E_{st}^{(1)}(j-1))}\ \text{for}\ j=1,\ldots,7$$

$$\frac{\max(E_{st}^{(2)}(j), E_{st}^{(2)}(j-1))}{\min(E_{st}^{(2)}(j), E_{st}^{(2)}(j-1))}\ \text{for}\ j=1,\ldots,8.$$

Unvoiced Signal Classification

The classification of unvoiced signal frames is based on the parameters described above, namely: the voicing measure $\overline{r}_x$, the average spectral tilt $\overline{e}_l$, the maximum short-time energy increase at low level dE0 and the maximum short-time energy variation dE. The algorithm is further supported by the tonal stability parameter, the SAD flag and the relative frame energy calculated during the noise energy update phase. For more detailed information about these parameters, see for example [Jelinek, M., et al., "Advances in source-controlled variable bitrate wideband speech coding", *Special Workshop in MAUI* (*SWIM*): Lectures by masters in speech processing, Maui, Hi., Jan. 12-14, 2004] of which the full content is herein incorporated by reference.

The relative frame energy is given by $$E_{rel} = E_t - \overline{E}_f$$

where $E_t$ is the total frame energy (in dB) and $\overline{E}_f$ is the long-term average frame energy, updated during each active frame by $\overline{E}_f = 0.99\overline{E}f - 0.01E_t$.

The rules for unvoiced classification of wideband signals are summarized below

[$(\overline{r}_x<0.695)$ AND $(\overline{e}_l<4.0)$) OR $(E_{rel}<-14)$] AND

[last frame INACTIVE OR UNVOICED OR ($(e_{old}<2.4)$ AND $(r_x(0)<0.66)$)]

[dE0<250] AND

[$e_t(1)<2.7$] AND

NOT [(tonal_stability AND ($(\overline{r}_x>0.52)$ AND $(\overline{e}_l>0.5)$) OR $(\overline{e}_l>0.85)$) AND $(E_{rel}>-14)$ AND SAD flag set to 1]

The first line of this condition is related to low-energy signals and signals with low correlation concentrating their energy in high frequencies. The second line covers voiced offsets, the third line covers explosive signal segments and the fourth line is related to voiced onsets. The last line discriminates music signals that would be otherwise declared as unvoiced.

If the combined conditions are fulfilled the classification ends by declaring the current frame as unvoiced.

Voiced Signal Classification

If a frame is not classified as inactive frame or as unvoiced frame then it is tested if it is a stable voiced frame. The decision rule is based on the normalized correlation $\overline{r}_x$ in each sub-frame (with ¼ subsample resolution), the average spectral tilt $\overline{e}_l$ and open-loop pitch estimates in all sub-frames (with ¼ subsample resolution).

The open-loop pitch estimation procedure calculates three open-loop pitch lags: $d_0$, $d_1$ and $d_2$, corresponding to the first half-frame, the second half-frame and the look-ahead (first half-frame of the following frame). In order to obtain a precise pitch information in all four sub-frames, ¼ sample resolution fractional pitch refinement is calculated. This refinement is calculated on a perceptually weighted input signal $s_{wd}(n)$ (for example the input sound signal s(n) filtered through the above described perceptual weighting filter). At the beginning of each sub-frame a short correlation analysis (40 samples) with resolution of 1 sample is performed in the interval (−7,+7) using the following delays: $d_0$ for the first and second sub-frames and $d_1$ for the third and fourth sub-frames. The correlations are then interpolated around their maxima at the fractional positions $d_{max}-3/4$, $d_{max}-1/2$, $d_{max}-1/4$, $d_{max}$, $d_{max}+1/4$, $d_{max}+1/2$, $d_{max}+3/4$. The value yielding the maximum correlation is chosen as the refined pitch lag.

Let the refined open-loop pitch lags in all four sub-frames be denoted as

T(0), T(1), T(2) and T(3) and their corresponding normalized correlations as C(0), C(1), C(2) and C(3). Then, the voiced signal classification condition is given by

[C(0)>0.605] AND
[C(1)>0.605] AND
[C(2)>0.605] AND
[C(3)>0.605] AND
[$\bar{e}_f$>4] AND
[|T(1)−T(0)|]<3 AND
[|T(2)−T(1)|]<3 AND
[|T(3)−T(2)|]<3

The above voiced signal classification condition indicates that the normalized correlation must be sufficiently high in all sub-frames, the pitch estimates must not diverge throughout the frame and the energy must be concentrated in low frequencies. If this condition is fulfilled the classification ends by declaring the current frame as voiced. Otherwise the current frame is declared as generic.

Although the present invention has been described in the foregoing description with reference to non-restrictive illustrative embodiments thereof, these embodiments can be modified at will within the scope of the appended claims without departing from the spirit and nature of the present invention.

What is claimed is:

1. A device for decoding a sound signal encoded in a bitstream including a gain codebook index, comprising:

at least one processor; and a memory coupled to the processor and comprising non-transitory code instructions that when executed cause the processor to implement:

a decoder of an adaptive codebook contribution of an excitation from the bitstream;

a decoder of a fixed codebook contribution of the excitation from the bitstream;

a device for retrieving quantized adaptive and fixed codebook gains in a sub-frame of a frame of the encoded sound signal, comprising:

an estimator of the fixed codebook gain in the sub-frame, wherein:

(i) the estimator is supplied with a parameter representative of a classification of the frame, (ii) the estimator, for a first sub-frame of the frame, uses the parameter representative of the classification of the frame and an energy of the fixed codebook contribution to estimate the fixed codebook gain, and (iii) the estimator comprises, for each sub-frame of the frame following the first sub-frame, (1) a logarithm calculator, (2) a calculator of a linear estimation of the fixed codebook gain in logarithmic domain using the parameter representative of the classification of the frame, quantized adaptive codebook gains of at least one previous sub-frame of the frame supplied to the calculator of linear estimation directly, and quantized fixed codebook gains of the at least one previous sub-frame supplied to the calculator of linear estimation in logarithmic domain through the logarithm calculator, and (3) a converter of the linear estimation in logarithmic domain in linear domain to produce the estimated fixed codebook gain;

a gain codebook for supplying the quantized adaptive codebook gain and a correction factor for the sub-frame in response to the gain codebook index; and a multiplier of the estimated fixed codebook gain by the correction factor to provide the quantized fixed codebook gain in the sub-frame;

a multiplier of the adaptive codebook contribution by the quantized adaptive codebook gain;

a multiplier of the fixed codebook contribution by the quantized fixed codebook gain;

an adder of the adaptive codebook contribution multiplied by the quantized adaptive codebook gain and the fixed codebook contribution multiplied by the quantized fixed codebook gain to form a total excitation; and a synthesis filter for synthesizing the sound signal by filtering the total excitation.

2. The sound signal decoding device according to claim 1, wherein the energy of the fixed codebook contribution is an energy of a filtered innovation codevector from the fixed codebook, and wherein the estimator comprises, for the first sub-frame of the frame, a calculator of a first estimation of the fixed codebook gain in response to the parameter representative of the classification of the frame, and a subtractor of the energy of the filtered innovation codevector from the fixed codebook from the first estimation to obtain the estimated fixed codebook gain.

3. The sound signal decoding device according to claim 1, wherein the estimator uses, for estimating the fixed codebook gain estimation coefficients different for each sub-frame of the frame.

4. The sound signal decoding device according to claim 1, wherein the estimator confines estimation of the fixed codebook gain in the frame to increase robustness against frame erasure.

5. A method for decoding a sound signal encoded in a bitstream including a gain codebook index, comprising:

decoding an adaptive codebook contribution of an excitation from the bitstream;

decoding a fixed codebook contribution of the excitation from the bitstream;

retrieving quantized adaptive and fixed codebook gains in a sub-frame of a frame of the encoded sound signal, comprising:

estimating the fixed codebook gain in the sub-frame, using a parameter representative of a classification of the frame, wherein:

estimating the fixed codebook gain, for a first sub-frame of the frame, uses the parameter representative of the classification of the frame and an energy of the fixed codebook contribution, and estimating the fixed codebook gain comprises, for each sub-frame of the frame following the first sub-frame, (a) calculating a linear estimation of the fixed codebook gain in logarithmic domain using the parameter representative of the classification of the frame, quantized adaptive codebook gains of at least one previous sub-frame of the frame, and quantized fixed codebook gains of the at least one previous sub-frame of the frame in logarithmic domain, and (b) converting the linear estimation in logarithmic domain in linear domain to produce the estimated fixed codebook gain;

supplying, from a gain codebook, the quantized adaptive codebook gain and a correction factor for the sub-frame in response to the gain codebook index; and multiplying the estimated fixed codebook gain by the correction factor to provide the quantized fixed codebook gain in the sub-frame;

multiplying the adaptive codebook contribution by the quantized adaptive codebook gain;

multiplying the fixed codebook contribution by the quantized fixed codebook gain;

adding the adaptive codebook contribution multiplied by the quantized adaptive codebook gain and the fixed codebook contribution multiplied by the quantized fixed codebook gain to form a total excitation; and synthesizing the sound signal by filtering the total excitation through a synthesis filter.

6. The sound signal decoding method according to claim 5, wherein the energy of the fixed codebook contribution is an energy of a filtered innovation codevector from the fixed codebook, and wherein estimating the fixed codebook gain comprises, for the first sub-frame of the frame, calculating a first estimation of the fixed codebook gain in response to the parameter representative of the classification of the frame, and subtracting the energy of the filtered innovation codevector from the fixed codebook from the first estimation to obtain the estimated fixed codebook gain.

7. The sound signal decoding method according to claim 5, wherein estimating the fixed codebook gain comprises using estimation coefficients different for each sub-frame of the frame.

8. The sound signal decoding method according to claim 5, wherein estimating the fixed codebook gain is confined in the frame to increase robustness against frame erasure.

9. A device for decoding a sound signal encoded in a bitstream including a gain codebook index, comprising:

at least one processor; and a memory coupled to the processor and comprising non-transitory code instructions that when executed cause the processor to:

decode an adaptive codebook contribution of an excitation from the bitstream;

decode a fixed codebook contribution of the excitation from the bitstream;

retrieve quantized adaptive and fixed codebook gains in a sub-frame of a frame of the encoded sound signal by:

estimating the fixed codebook gain in the sub-frame using a parameter representative of a classification of the frame, wherein:

estimating the fixed codebook gain, for a first sub-frame of the frame, uses the parameter representative of the classification of the frame and an energy of the fixed codebook contribution, and estimating the fixed codebook gain comprises, for each sub-frame of the frame following the first sub-frame, (a) calculating a linear estimation of the fixed codebook gain in logarithmic domain using the parameter representative of the classification of the frame, quantized adaptive codebook gains of at least one previous sub-frame of the frame, and quantized fixed codebook gains of the at least one previous sub-frame of the frame in logarithmic domain, and (b) converting the linear estimation in logarithmic domain in linear domain to produce the estimated fixed codebook gain;

supplying from a gain codebook the quantized adaptive codebook gain and a correction factor for the sub-frame in response to the gain codebook index; and multiplying the estimated fixed codebook gain by the correction factor to provide the quantized fixed codebook gain in the sub-frame;

multiply the adaptive codebook contribution by the quantized adaptive codebook gain;

multiply the fixed codebook contribution by the quantized fixed codebook gain;

add the adaptive codebook contribution multiplied by the quantized adaptive codebook gain and the fixed codebook contribution multiplied by the quantized fixed codebook gain to form a total excitation; and synthesize the sound signal by filtering the total excitation through a synthesis filter.

10. A device for decoding a sound signal encoded in a bitstream including a gain codebook index, comprising:

at least one processor; and a memory coupled to the processor and comprising non-transitory code instructions that when executed cause the processor to implement:

a decoder of an adaptive codebook contribution of an excitation from the bitstream;

a decoder of a fixed codebook contribution of the excitation from the bitstream;

a device for retrieving quantized adaptive and fixed codebook gains in a sub-frame of a frame of the encoded sound signal, comprising:

an estimator of the fixed codebook gain in the sub-frame, wherein:

(i) the estimator is supplied with a parameter representative of a classification of the frame, (ii) the estimator, for a first sub-frame of the frame, uses the parameter representative of the classification of the frame and an energy of the fixed codebook contribution to estimate the fixed codebook gain, and (iii) the estimator comprises, for each sub-frame of the frame following the first sub-frame, (1) a calculator of a linear estimation of the fixed codebook gain in logarithmic domain using the classification parameter of the frame, adaptive and fixed codebook gains of at least one previous sub-frame of the frame, and estimation coefficients which are different for each sub-frame, and (2) a converter of the linear estimation in logarithmic domain in linear domain to produce the estimated fixed codebook gain;

a gain codebook for supplying the quantized adaptive codebook gain and a correction factor for the sub-frame in response to the gain codebook index; and a multiplier of the estimated fixed codebook gain by the correction factor to provide the quantized fixed codebook gain in the sub-frame;

a multiplier of the adaptive codebook contribution by the quantized adaptive codebook gain;

a multiplier of the fixed codebook contribution by the quantized fixed codebook gain;

an adder of the adaptive codebook contribution multiplied by the quantized adaptive codebook gain and the fixed codebook contribution multiplied by the quantized fixed codebook gain to form a total excitation; and a synthesis filter for synthesizing the sound signal by filtering the total excitation.

11. A device for decoding a sound signal encoded in a bitstream including a gain codebook index, comprising:

at least one processor; and a memory coupled to the processor and comprising non-transitory code instructions that when executed cause the processor to:

decode an adaptive codebook contribution of an excitation from the bitstream;

decode a fixed codebook contribution of the excitation from the bitstream;

retrieve quantized adaptive and fixed codebook gains in a sub-frame of a frame of the encoded sound signal by:

estimating the fixed codebook gain in the sub-frame using a parameter representative of a classification of the frame, wherein:

estimating the fixed codebook gain, for a first sub-frame of the frame, uses the parameter representative of the classification of the frame and an energy of the fixed codebook contribution, and estimating the fixed codebook gain comprises, for each sub-frame of the frame following the first sub-frame, (a) calculating a linear estimation of the fixed codebook gain in logarithmic domain using the classification parameter of the frame, adaptive and fixed codebook gains of at least one previous sub-frame of the frame, and estimation coefficients which are different for each sub-frame, and (b) converting the linear estimation in logarithmic domain in linear domain to produce the estimated fixed codebook gain;

supplying from a gain codebook the quantized adaptive codebook gain and a correction factor for the sub-frame in response to the gain codebook index; and multiplying the estimated fixed codebook gain by the correction factor to provide the quantized fixed codebook gain in the sub-frame;

multiply the adaptive codebook contribution by the quantized adaptive codebook gain;

multiply the fixed codebook contribution by the quantized fixed codebook gain;

add the adaptive codebook contribution multiplied by the quantized adaptive codebook gain and the fixed codebook contribution multiplied by the quantized fixed codebook gain to form a total excitation; and synthesize the sound signal by filtering the total excitation through a synthesis filter.

12. A method for decoding a sound signal encoded in a bitstream including a gain codebook index, comprising:

decoding an adaptive codebook contribution of an excitation from the bitstream;

decoding a fixed codebook contribution of the excitation from the bitstream;

retrieving quantized adaptive and fixed codebook gains in a sub-frame of a frame of the encoded sound signal, comprising:

estimating the fixed codebook gain in the sub-frame, using a parameter representative of a classification of the frame, wherein:

estimating the fixed codebook gain, for a first sub-frame of the frame, uses the parameter representative of the classification of the frame and an energy of the fixed codebook contribution, and estimating the fixed codebook gain comprises, for each sub-frame of the frame following the first sub-frame, (a) calculating a linear estimation of the fixed codebook gain in logarithmic domain using the classification parameter of the frame, adaptive and fixed codebook gains of at least one previous sub-frame of the frame, and estimation coefficients which are different for each sub-frame, and (b) converting the linear estimation in logarithmic domain in linear domain to produce the estimated fixed codebook gain;

supplying, from a gain codebook, the quantized adaptive codebook gain and a correction factor for the sub-frame in response to the gain codebook index; and multiplying the estimated fixed codebook gain by the correction factor to provide the quantized fixed codebook gain in the sub-frame;

multiplying the adaptive codebook contribution by the quantized adaptive codebook gain;

multiplying the fixed codebook contribution by the quantized fixed codebook gain;

adding the adaptive codebook contribution multiplied by the quantized adaptive codebook gain and the fixed codebook contribution multiplied by the quantized fixed codebook gain to form a total excitation; and synthesizing the sound signal by filtering the total excitation through a synthesis filter.

* * * * *